US006710584B2

(12) United States Patent
Kuroiwa et al.

(10) Patent No.: US 6,710,584 B2
(45) Date of Patent: Mar. 23, 2004

(54) SERIES REGULATOR

(75) Inventors: Tatsuo Kuroiwa, Tokyo (JP); Shinobu Utsunomiya, Tokyo (JP); Tomomi Oda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 271 days.

(21) Appl. No.: 10/024,363

(22) Filed: Dec. 21, 2001

(65) Prior Publication Data

US 2003/0011349 A1 Jan. 16, 2003

(30) Foreign Application Priority Data

Jul. 16, 2001 (JP) ..... 2001-215792

(51) Int. Cl.[7] ..... G05F 1/40
(52) U.S. Cl. ..... 323/281; 323/280
(58) Field of Search ..... 323/281, 280, 323/273, 315, 317, 316

(56) References Cited

U.S. PATENT DOCUMENTS 4,559,488 A * 12/1985 Minakuchi ..... 323/281
4,667,145 A * 5/1987 Moreau ..... 323/275
6,188,211 B1 * 2/2001 Rincon-Mora et al. ..... 323/280

FOREIGN PATENT DOCUMENTS

JP 2-150911 6/1990

* cited by examiner

*Primary Examiner*—Shawn Riley
(74) *Attorney, Agent, or Firm*—Leydig, Voit & Mayer, Ltd.

(57) ABSTRACT

In the series regulator, when an external starting voltage source has started operation, a bias current is supplied from a fourth transistor to a reference voltage circuit, and a reference voltage is supplied form the reference voltage circuit to an amplifier. When an output voltage of a power transistor rises, and a value of a divided voltage applied to a sixth transistor has reached a value of a constant voltage being applied to a fifth transistor, the sixth transistor is turned on, and the fifth transistor is turned off. A tenth transistor starts supplying a bias current to the reference voltage circuit. At the same time, a bias switching circuit starts operation, and interrupts a supply of the bias current from the fourth transistor to the reference voltage circuit.

7 Claims, 6 Drawing Sheets

SERIES REGULATOR

FIELD OF THE INVENTION

The present invention relates to a series regulator that is used for obtaining a stabilized power source in a compact device like a portable telephone.

BACKGROUND OF THE INVENTION

Series regulators are provided in the form of ICs using bipolar transistors and unipolar transistors. Series regulators using bipolar transistors will be explained below as an example.

FIG. 5 is a circuit diagram showing a basic structure of a conventional series regulator. As shown in FIG. 5, a power transistor 503 is connected in series between an input terminal 501 to which a non-stabilized voltage Vin output from an external starting voltage source is applied and an output terminal 502 to which a stabilized voltage Vout is output. Input ends (emitters) of transistors E1, E2 and E3 that constitute a bias current circuit are connected to a line that connects the input terminal 501 and an input end (emitter) of the power transistor 503.

The transistor E1 and the transistors E2 and E3 that are in diode connection have their control ends (bases) connected in common to constitute a current mirror circuit. A constant-current source 504 is provided between an output end (collector) of the transistor E1 and the ground. An output end (collector) of the transistor E2 is connected to a reference voltage circuit 505 and a negative-phase input end of an amplifier 506. An output end (collector) of the transistor E3 is connected to a bias input end of the amplifier 506.

A series circuit of resistors R1 and R2 is provided between a line that connects an output end (collector) of the power transistor 503 and an output terminal 502 and the ground. A control end of the reistors R1 and R2 is connected to a positive-phase input end of the amplifier 506. An output end of the amplifier 506 is connected to a control end (base) of the power transistor 503.

In the series regulator having the above structure, when the external starting voltage source has started operation, a constant bias current is supplied to the reference voltage circuit 505 based on a current mirror operation of the transistors E1 and E2, and a reference voltage is supplied to the amplifier 506 from the reference voltage circuit 505. At the same time, a bias current is supplied to the amplifier 506 from the transistor E3, and the amplifier 506 starts the operation of changing the internal resistance of the power transistor 503. The output voltage of the power transistor 503 is supplied to the amplifier 506 after being divided by the series circuit of the resistors R1 and R2.

As a result, the amplifier 506 changes the internal resistance of the power transistor 503 based on the result of a comparison between the magnitude of the reference output voltage and the magnitude of the divided voltage, and output a stable constant output voltage Vout from the output terminal 502. As explained above, according to the conventional series regulator, the reference voltage circuit 505 and the amplifier 506 operate based on the bias current supplied from the input side.

However, when the power source of the external starting voltage source is turned on, the output voltage, that is, the input voltage Vin of the series regulator, varies in many cases, as shown in FIG. 6, for example. In this case, according to the conventional series regulator, the reference voltage circuit and the amplifier operate by receiving a supply of a bias current that varies following the variation in the input voltage Vin. Therefore, there occurs a fluctuation in the reference voltage, and a ripple is generated in the output voltage Vout as shown in FIG. 6. This becomes one of factors that aggravates a ripple removal ratio.

SUMMARY OF THE INVENTION

It is an object of the present invention to provide a series regulator capable of reducing a ripple voltage that appears in the output voltage due to a variation in the input voltage during a normal operation after a stable voltage has been obtained following the turning-on of the power source, and capable of improving a ripple removal ratio of the series regulator.

The series regulator according to one aspect of the present invention comprises: a power transistor connected in series between an input terminal to which a non-stabilized voltage is applied and an output terminal; an amplifier for changing an internal resistance of the power transistor based on a result of a comparison between an output voltage of the power transistor and a reference voltage, and outputting a stabilized constant voltage to the output terminal; a first bias current circuit for generating a bias current to be supplied to a reference voltage circuit that generates the reference voltage, based on a non-stabilized voltage applied to the input terminal; a resistance voltage dividing circuit for generating a divided voltage of a predetermined value from an output voltage of the power transistor; an output voltage detecting circuit including a first transistor to a control end of which there is applied a conversion voltage of a bias current that the first bias current circuit supplies to the reference voltage circuit; and a second transistor to a control end of which there is applied the divided voltage, wherein the output voltage detecting circuit having a differential structure such that the second transistor is turned on and the first transistor is turned off when the divided voltage has reached a value of the conversion voltage; a second bias current circuit for generating a bias current to be supplied to the reference voltage circuit in response to the on-operation of the second transistor, based on an output voltage of the power transistor; and a bias switching circuit for stopping a bias-current supply operation of the first bias current circuit in response to a starting of the operation of the second bias current circuit.

Thus, when a non-stabilized voltage has been applied to an input terminal, a bias current is supplied to a reference voltage circuit from a first bias current circuit provided at the input side. Then, an amplifier starts the control of a power transistor. In an output voltage detecting circuit, a first transistor is applied with a conversion voltage of a bias current at its control end, and is turned on. When the output voltage of the power transistor rises, and a value of a divided voltage generated by a resistance voltage dividing circuit has reached a value of a conversion voltage of the bias current, a second transistor is turned on in the output voltage detecting circuit. Therefore, a second bias current circuit starts supplying a bias current to the reference voltage circuit. At the same time, a bias switching circuit operates to stop the bias-current supply operation of the first bias current circuit.

The series regulator according to another aspect of the present invention comprises: a power transistor connected in series between an input terminal to which a non-stabilized voltage is applied and an output terminal; an amplifier for changing an internal resistance of the power transistor based on a result of a comparison between an output voltage of the power transistor and a reference voltage, and outputting a stabilized constant voltage to the output terminal; a resistance voltage dividing circuit for generating a divided voltage of a predetermined value from an output voltage of the power transistor; a first bias current circuit for generating a bias current to be supplied to a reference voltage circuit that generates the reference voltage, based on a non-stabilized voltage applied to the input terminal, the first bias current circuit for supplying a bias current to the reference voltage circuit during a period while a first transistor to a control end of which a conversion voltage of the bias current is applied is in on-operation; and a second bias current circuit for generating a bias current to be supplied to the reference voltage circuit, based on an output voltage of the power transistor, the second bias current circuit for supplying a bias current to the reference voltage circuit during a period while a second transistor to a control end of which the divided voltage is applied is in on-operation, wherein the first bias current circuit and the second bias current circuit are differentially structured such that the second transistor is turned on when the divided voltage has reached a value of the conversion voltage, and the first transistor is turned off following this.

Thus, a first bias current circuit provided at an input side and a second bias current circuit provided at an output side are differentially structured. Therefore, when a non-stabilized voltage has been applied to an input end, a first transistor is turned on, and a bias current is supplied from the first bias current circuit to a reference voltage circuit. Then, an amplifier starts controlling a power transistor. The first transistor is applied with a conversion voltage of the bias current, and continues the on-operation. A second transistor of the second bias current circuit that is differentially structured is in an off-status. When the output voltage of the power transistor rises, and a value of a divided voltage generated by a resistance voltage dividing circuit has reached a value of a conversion voltage of the bias current, the second transistor is turned on. Therefore, the second bias current circuit starts supplying a bias current to the reference voltage circuit. On the other hand, in the first bias current circuit, the first transistor is turned off. Therefore, the first bias current circuit stops supplying the bias current to the reference voltage circuit. In other words, as the first bias current circuit provided at the input side and the second bias current circuit provided at the output side are differentially structured, these bias current circuits constitute a bias switching circuit as a total system.

The series regulator according to another aspect of the present invention comprises: a first power transistor connected in series between an input terminal to which a non-stabilized voltage is applied and a first output terminal; a first amplifier for changing an internal resistance of the first power transistor based on a result of a comparison between an output voltage of the first power transistor and a reference voltage, and outputting a stabilized constant voltage to the first output terminal; a second power transistor connected in series between the input terminal and a second output terminal; a second amplifier for changing an internal resistance of the second power transistor based on a result of a comparison between an output voltage of the second power transistor and the reference voltage, and outputting a stabilized constant voltage to the second output terminal; a first resistance voltage dividing circuit for generating a first divided voltage of a predetermined value from an output voltage of the first power transistor, and a second resistance voltage dividing circuit for generating a second divided voltage of a predetermined value different from the first divided voltage, from an output voltage of the second power transistor; a first bias current circuit for generating a bias current to be supplied to a reference voltage circuit that generates the reference voltage, based on a non-stabilized voltage applied to the input terminal, the first bias current circuit for supplying a bias current to the reference voltage circuit during a period while a first transistor to a control end of which a conversion voltage of the bias current is applied is in on-operation; a second bias current circuit for generating a bias current to be supplied to the reference voltage circuit, based on an output voltage of the first power transistor, the second bias current circuit for supplying a bias current to the reference voltage circuit during a period while a second transistor to a control end of which the first divided voltage is applied is in on-operation; and a third bias current circuit for generating a bias current to be supplied to the reference voltage circuit, based on an output voltage of the second power transistor, the third bias current circuit for supplying a bias current to the reference voltage circuit during a period while a third transistor to a control end of which the second divided voltage is applied is in on-operation, wherein the first bias current circuit, the second bias current circuit, and the third bias current circuit are differentially structured such that only a corresponding one of the second transistor and the third transistor is turned on when either the first divided voltage or the second divided voltage having a higher value has first reached a value of the conversion voltage, and the first transistor is turned off following this.

Thus, a first bias current circuit provided at an input side, a second bias current circuit provided at one output side, a third bias current circuit provided at the other output side are differentially structured. Therefore, when a non-stabilized voltage has been applied to an input end, a first transistor is turned on, and a bias current is supplied from the first bias current circuit to a reference voltage circuit. Then, a first amplifier starts controlling a first power transistor, and a second amplifier starts controlling a second power transistor. The first transistor is applied with a conversion voltage of the bias current, and continues the on-operation. A second transistor of the second bias current circuit and a third transistor of the third bias current circuit that are differentially structured are in an off-status. When the output voltages of the first and second power transistors rise, and when either a first divided voltage generated by a first resistance dividing circuit or a second divided voltage generated by a second resistance dividing circuit having a higher value has first reached a value of the conversion voltage, the corresponding one of the second transistor and the third transistor is turned on. The first transistor is turned off following this. As a result, a bias current is supplied to the reference voltage circuit from the corresponding one of the second bias current circuit and the third bias current circuit. At the same time, the first bias current circuit stops supplying the bias current. Stabilized voltages are output from the two output terminals respectively. In other words, as the first bias current circuit provided at the input side, the second bias current circuit provided at one output side, and the third bias current circuit provided at the other output side are differentially structured, these bias current circuits constitute a bias switching circuit as a total system.

Other objects and features of this invention will become apparent from the following description with reference to the accompanying drawings.

DESCRIPTION OF THE PREFERRED EMBODIMENTS

Embodiment/s of a series regulator relating to the present invention will be explained in detail below with reference to the accompanying drawings.

Figure 1:
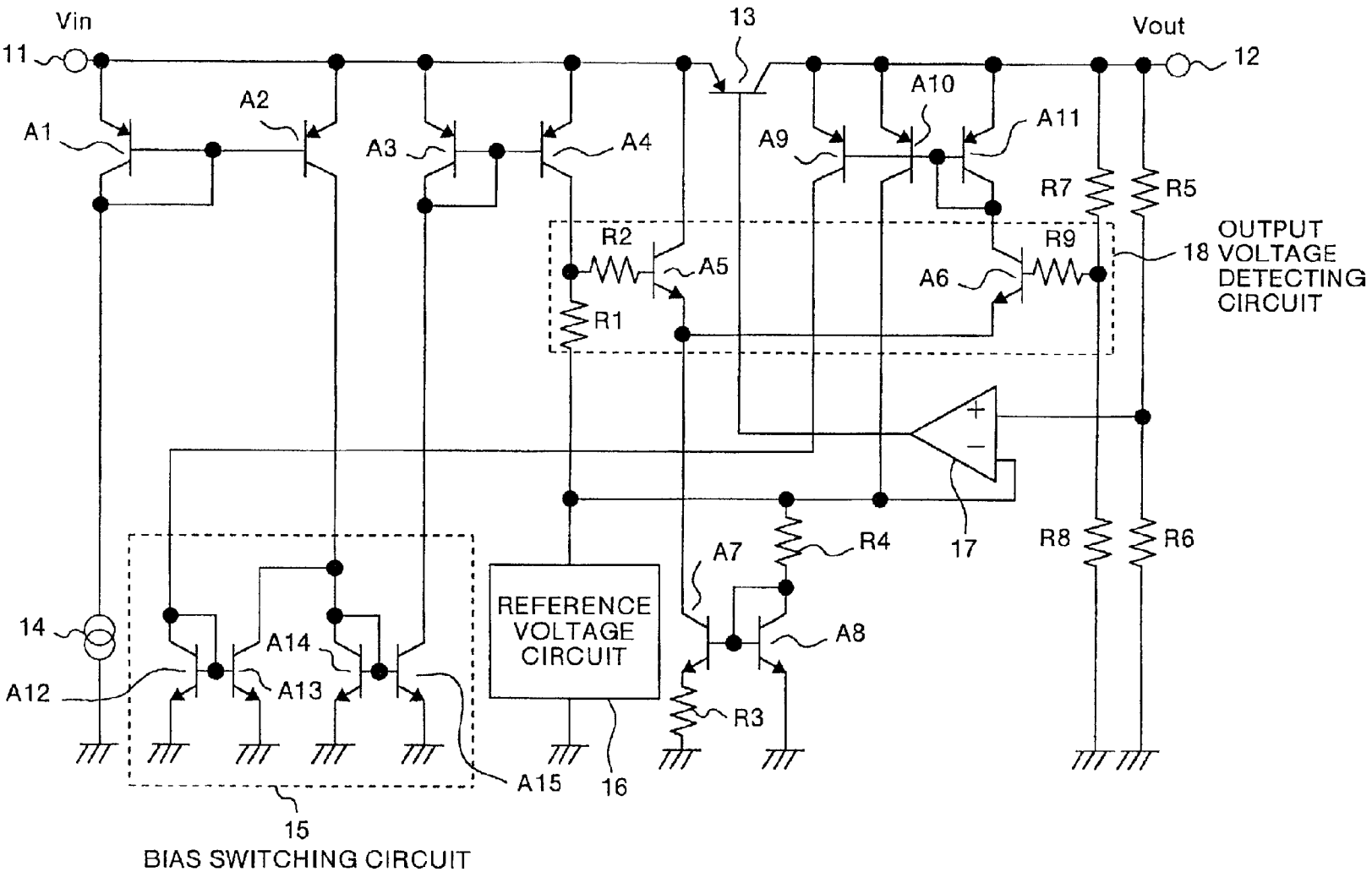
FIG. 1 is a circuit diagram showing a structure of a series regulator according to a first embodiment of the present invention.

FIG. 1 is a circuit diagram showing a structure of a series regulator according to a first embodiment of the present invention. FIG. 1 shows only the structure that is related to the first embodiment. This similarly applies to other diagrams showing the rest of embodiments.

As shown in FIG. 1, a power transistor 13 is connected in series between an input terminal 11 to which a non-stabilized voltage Vin output from an external starting voltage source is applied and an output terminal 12 from which a stabilized voltage Vout is output. Input ends (emitters) of transistors A1, A2, A3, and A4 that constitute a bias current circuit are connected to a line that connects between the input terminal 11 and an input end (emitter) of the power transistor 13.

The transistor A1 and the transistor A2 that are in diode connection have their control ends (bases) connected in common to constitute a current mirror circuit. A constant-current source 14 is provided between an output end (collector) of the transistor A1 and the ground. An output end (collector) of the transistor A2 is connected to a bias switching circuit 15.

The transistor A3 and the transistor A4 that are in diode connection have their control ends (bases) connected in common to constitute a current mirror circuit. A bias switching circuit 15 is provided between an output end (collector) of the transistor A3 and the ground. An output end (collector) of the transistor A4 is connected to a reference voltage circuit 16 via a resistor R1.

An input end (collector) of a transistor A5 is connected to a line that connects between the input terminal 11 and an input end (emitter) of the power transistor 13. A control end (base) of the transistor A5 is connected to an output end (collector) of the transistor A4 via a resistor R2. An output end (emitter) of the transistor A5 and an output end (emitter) of a transistor A6 are connected to an input end (collector) of a transistor A7. The transistors A5 and A6 constitute an output voltage detecting circuit 18.

The transistor A7 has its control end (base) connected to a control end (base) of a transistor A8, and has its output end (emitter) connected to the ground via a resistor R3. The transistor A8 has its input end (collector) connected to a line that connects between the reference voltage circuit 16 and a negative-phase input end of an amplifier 17 via a resistor R4. The transistor A8 has its output end (emitter) directly connected to the ground.

A series circuit of resistors R5 and R6 and a series circuit of resistors R7 and R8 are provided between a line that connects between an output end (collector) of the power transistor 13 and the output terminal 12 and the ground. A connection end of the resistors R5 and R6 is connected to a positive-phase input end of the amplifier 17. An output end of the amplifier 17 is connected to a control end (base) of the power transistor 13. A connection end of the resistors R7 and R8 is connected to a control end (base) of the transistor A6 via a resistor R9.

Input ends (emitters) of transistors A9, A10 and A11 that constitute a bias current circuit are connected to a line that connects between an output end (collector) of the power transistor 13 and the output terminal 12. The transistor A9, the transistor A10, and the transistor A11 that are in diode connection have their control ends (bases) connected in common to constitute a current mirror circuit.

An output end (collector) of the transistor A11 is connected to an input end (emitter) of the transistor A6. An output end (collector) of the transistor A10 is connected to a line that connects between the reference voltage circuit 16 and the negative-phase input end of the amplifier 17. An output end (collector) of the transistor A9 is connected to the bias switching circuit 15.

The bias switching circuit 15 includes a current mirror circuit constructed of a transistor A12 and a transistor A13 that are in diode connection, and a current mirror circuit constructed of a transistor A14 and a transistor A15 that are in diode connection. The transistor A12 and the transistor A13 that are in diode connection have their control ends (bases) connected in common, and have their output ends (emitters) directly connected to the ground respectively. The transistor A14 and the transistor A15 that are in diode connection have their control ends (bases) connected in common, and have their output ends (emitters) directly connected to the ground respectively.

An input end (collector) of the transistor A12 in diode connection is connected to an output end (collector) of the transistor A9. An input end (collector) of the transistor A13 and an input end (collector) of the transistor A14 are connected to the output end (collector) of the transistor A2. An input end (collector) of the transistor A15 is connected to the output end (collector) of the transistor A3.

The operation of the series regulator according to the first embodiment will be explained next. When the external starting voltage source has started operation, the current mirror circuit of the transistors A1 and A2 and the current mirror circuit of the transistors A12 and A13 operate to generate a constant current. Based on this, the current mirror circuit of the transistors A3 and A4 operates to supply a bias current from the transistor A4 to the reference voltage circuit 16.

As the current mirror circuit of the transistors A7 and A8 operates based on the above operation, a conversion voltage (constant voltage) of the bias current supplied is applied to the control end (base) of the transistor A5, and the transistor A5 is turned on.

When the constant bias current has been supplied to the reference voltage circuit 16, the reference voltage circuit 16 supplies a reference voltage to the negative-phase input end of the amplifier 17. Although not shown, a bias current is supplied from the input side to the amplifier 17 at the same time, and the amplifier 17 starts the operation of changing the internal resistance of the power transistor 13. The output voltage of the power transistor 13 is divided by the series circuit of the resistors R5 and R6, and this divided voltage is supplied to the positive-phase input end of the amplifier 17. Further, the output voltage of the power transistor 13 is dived by the series circuit of the resistors R7 and R8, and this divided voltage is applied to the control end (base) of the transistor A6.

When the output voltage of the power transistor 13 rises, and a value of the divided voltage applied to the control end (base) of the transistor A6 has risen to a value of a constant voltage applied to the control end (base) of the transistor A5, the transistor A6 is turned on and the transistor A5 is turned off in the output voltage detecting circuit 18.

When the transistor A6 has been turned on, a current flows to the control ends (bases) of the transistors A9, A10 and A11 respectively, and these transistors A9, A10 and A11 are turned on. The transistor A11 starts supplying a bias current to the reference voltage circuit 16. At the same time, the transistor A9 is turned on. Therefore, the current mirror circuit of the transistors A12 and A13 of the bias switching circuit 10 starts operating. Then, a constant current that has so far been flowing to the transistor A14 is taken into the transistor A13, and the current mirror circuit of the transistors A14 and A15 is turned off.

As a result, the current mirror circuit of the transistors A3 and A4 is turned off, and the supply of the bias current from the transistor A4 to the reference voltage circuit 16 is interrupted. Thereafter, the output voltage Vout is constant even when there is a variation in the input voltage Vin. Therefore, the reference voltage circuit 16 receives a supply of the bias current having no variation from the transistor A10 at the output side.

As explained above, according to the first embodiment, when the output voltage Vout has reached a predetermined voltage after the power source has been turned on, the supply source of the bias current is switched immediately from the input side to the output side. Therefore, it is possible to reduce the influence on the reference voltage due to the variation in the input voltage. As a result, it is possible to reduce a ripple voltage that appears in the output voltage due to the variation in the input voltage, during a normal operation after a stable output voltage has been obtained following the turning-on of the power source. Consequently, it is possible to improve the ripple removal ratio of the series regulator.

Figure 2:
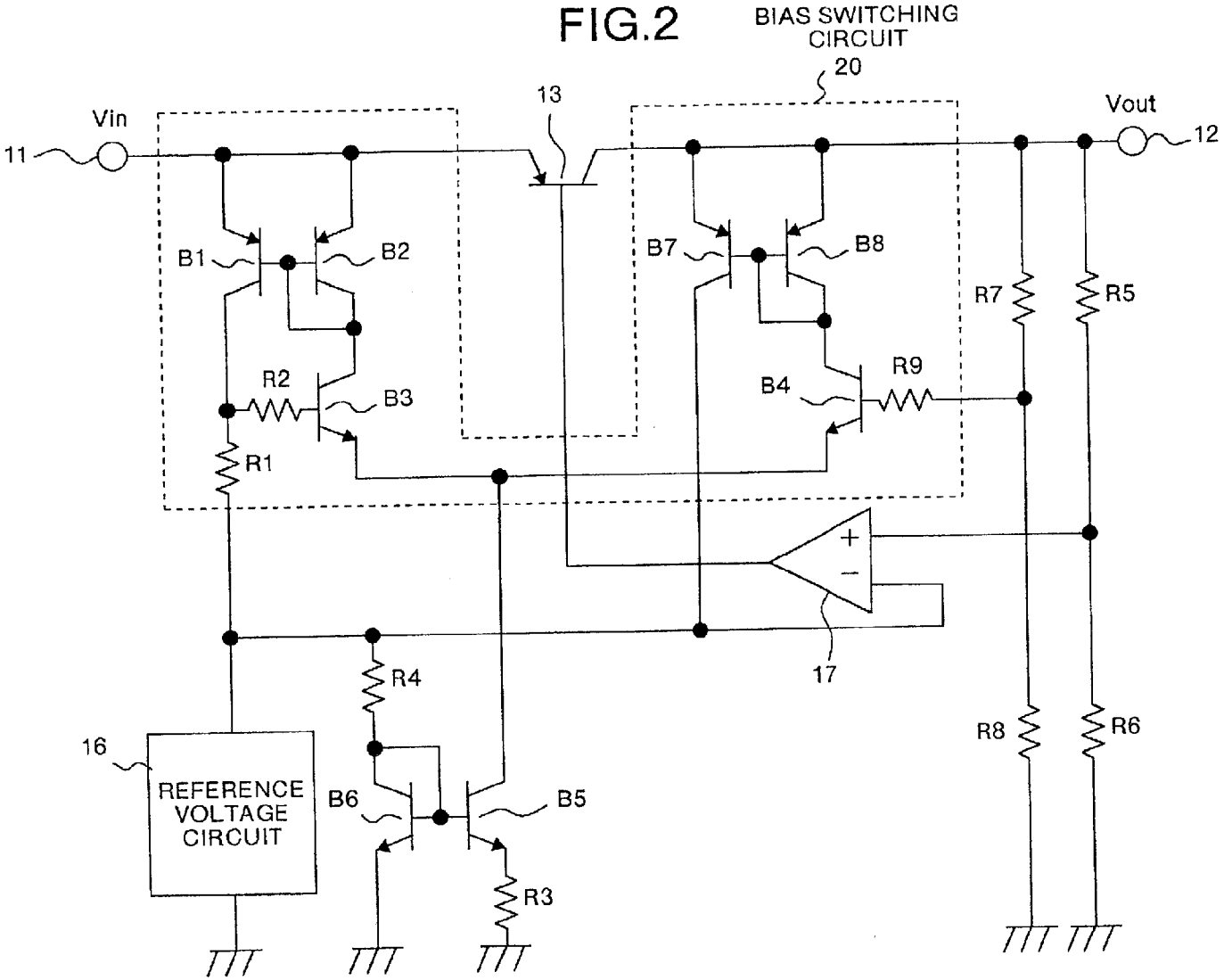
FIG. 2 is a circuit diagram showing a structure of a series regulator according to a second embodiment of the present invention.

FIG. 2 is a circuit diagram showing a structure of a series regulator according to a second embodiment of the present invention. As shown in FIG. 2, a power transistor 13 is connected in series between an input terminal 11 to which a non-stabilized voltage Vin output from an external starting voltage source is applied and an output terminal 12 from which a stabilized voltage Vout is output. Input ends (emitters) of transistors B1 and B2 that constitute a bias current circuit are connected to a line that connects between the input terminal 11 and an input end (emitter) of the power transistor 13.

The transistor B1 and the transistor B2 that are in diode connection have their control ends (bases) connected in common to constitute a current mirror circuit. An output end (collector) of the transistor B1 is connected to a reference voltage circuit 16 via a resistor R1, and is also connected to a negative-phase input end of an amplifier 17. An output end (collector) of the transistor B2 in diode connection is connected to an input end (collector) of a transistor B3.

The transistor B3 has its control end (base) connected to an output end (collector) of the transistor B1 via a resistor R2. An output end (emitter) of the transistor B3 and an output end (emitter) of the transistor B4 are connected to an input end (collector) of a transistor B5. The transistor B5 has its control end (base) connected to a control end (base) of a transistor B6 in diode connection, and has its output end (emitter) connected to the ground via a resistor R3. The transistor B6 has its input end (collector) connected to a line that connects between the reference voltage circuit 16 and the negative-phase input end of the amplifier 17 via a resistor R4. An output end (emitter) of the transistor B6 is directly connected to the ground.

A series circuit of resistors R5 and R6 and a series circuit of resistors R7 and R8 are provided between a line that connects between an output end (collector) of the power transistor 13 and the output terminal 12 and the ground. A connection end of the resistors R5 and R6 is connected to a positive-phase input end of the amplifier 17. An output end of the amplifier 17 is connected to a control end (base) of the power transistor 13. A connection end of the resistors R7 and R8 is connected to a control end (base) of the transistor B4 via a resistor R9.

Input ends (emitters) of transistors B7 and B8 that constitute a bias current circuit are connected to a line that connects between an output end (collector) of the power transistor 13 and the output terminal 12. The transistor B7 and the transistor B8 that are in diode connection have their control ends (bases) connected in common to constitute a current mirror circuit.

An output end (collector) of the transistor B7 is connected to a line that connects between the reference voltage circuit 16 and the negative-phase input end of the amplifier 17. An output end (collector) of the transistor B8 in diode connection is connected to an input end (emitter) of the transistor B4. The transistors B1 to B4, B7 and B8 constitute a bias switching circuit.

The operation of the series regulator according to the second embodiment will be explained next. When the external starting voltage source has started operation, the current mirror circuit of the transistors B5 and B6 operates to generate a constant current. Based on this, the current mirror circuit of the transistors B1 and B2 operates to supply a bias current from the transistor B1 to the reference voltage circuit 16. Based on this, a conversion voltage (constant voltage) of the bias current supplied is applied to the control end (base) of the transistor B3, and the transistor B3 is turned on.

When the constant bias current has been supplied to the reference voltage circuit 16, the reference voltage circuit 16 supplies a reference voltage to the negative-phase input end of the amplifier 17. Although not shown, a bias current is supplied from the input side to the amplifier 17 at the same time, and the amplifier 17 starts the operation of changing the internal resistance of the power transistor 13. The output voltage of the power transistor 13 is divided by the series circuit of the resistors R5 and R6, and this divided voltage is supplied to the positive-phase input end of the amplifier 17. Further, the output voltage of the power transistor 13 is dived by the series circuit of the resistors R7 and R8, and this divided voltage is applied to the control end (base) of the transistor B4.

When the output voltage of the power transistor 13 rises, and a value of the divided voltage applied to the control end (base) of the transistor B4 has risen to a value of a constant voltage applied to the control end (base) of the transistor B3, the transistor B4 is turned on and the transistor B3 is turned off.

When the transistor B4 has been turned on, a current flows to the control ends (bases) of the transistors B7 and B8 respectively, and these transistors B7 and B8 are turned on.

The transistor B7 starts supplying a bias current to the reference voltage circuit 16. At the same time, the transistor B3 is turned off. Therefore, the current mirror circuit of the transistors B1 and B2 is turned off.

As a result, the supply of the bias current from the transistor B1 to the reference voltage circuit 16 is interrupted. Thereafter, the output voltage Vout is constant even when there is a variation in the input voltage Vin. Therefore, the reference voltage circuit 16 receives a supply of the bias current having no variation from the transistor B7 at the output side.

As explained above, according to the second embodiment, when the output voltage Vout has reached a predetermined voltage after the power source has been turned on, the supply source of the bias current is switched immediately from the input side to the output side, using a smaller number of elements than that in the first embodiment. Therefore, it is possible to reduce the influence on the reference voltage due to the variation in the input voltage, in a similar manner to that of the first embodiment. As a result, it is possible to reduce a ripple voltage that appears in the output voltage due to the variation in the input voltage, during a normal operation after a stable output voltage has been obtained following the turning-on of the power source. Consequently, it is possible to improve the ripple removal ratio of the series regulator.

Figure 3:
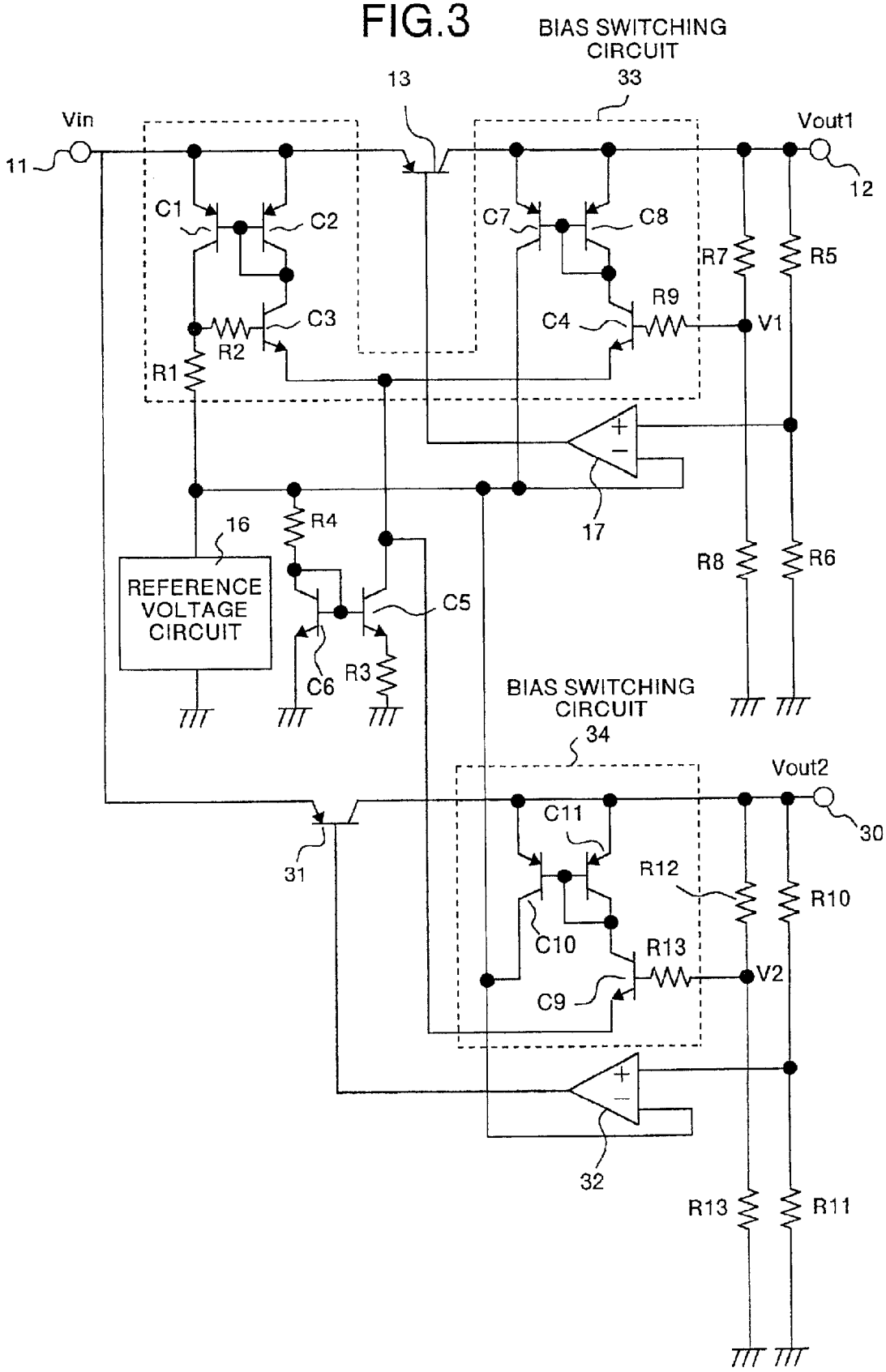
FIG. 3 is a circuit diagram showing a structure of a series regulator according to a third embodiment of the present invention.

FIG. 3 is a circuit diagram showing a structure of a series regulator according to a third embodiment of the present invention. The third embodiment shows an example of a structure of a series regulator that can obtain two outputs.

As shown in FIG. 3, a power transistor 13 is connected in series between an input terminal 11 to which a non-stabilized voltage Vin output from an external starting voltage source is applied and an output terminal 12 from which a stabilized voltage Vout1 is output. A power transistor 31 is connected in series between the input terminal 11 and an output terminal 30 from which a stabilized voltage Vout2 is output. An amplifier 32 is provided following this. One reference voltage circuit 16 can be used in common.

Input ends (emitters) of transistors C1 and C2 that constitute a bias current circuit are connected to a line that connects between the input terminal 11 and an input end (emitter) of the power transistor 13. The transistor C1 and the transistor C2 that are in diode connection have their control ends (bases) connected in common to constitute a current mirror circuit. An output end (collector) of the transistor C1 is connected to the reference voltage circuit 16 via a resistor R1, and is also connected to a negative-phase input end of an amplifier 17. An output end (collector) of the transistor C2 in diode connection is connected to an input end (collector) of a transistor C3.

The transistor C3 has its control end (base) connected to an output end (collector) of the transistor C2 via a resistor R2. An output end (emitter) of the transistor C3 and an output end (emitter) of the transistor C4 are connected to an input end (collector) of a transistor C5. The transistor C5 has its control end (base) connected to a control end (base) of a transistor C6 in diode connection, and has its output end (emitter) connected to the ground via a resistor R3. The transistor C6 has its input end (collector) connected to a line that connects between the reference voltage circuit 16 and the negative-phase input end of the amplifier 17 via a resistor R4. An output end (emitter) of the transistor C6 is directly connected to the ground.

A series circuit of resistors R5 and R6 and a series circuit of resistors R7 and R8 are provided between a line that connects between an output end (collector) of the power transistor 13 and the output terminal 12 and the ground. A connection end of the resistors R5 and R6 is connected to a positive-phase input end of the amplifier 17. An output end of the amplifier 17 is connected to a control end (base) of the power transistor 13. A connection end of the resistors R7 and R8 is connected to a control end (base) of the transistor C4 via a resistor R9.

Input ends (emitters) of transistors C7 and C8 that constitute a bias current circuit are connected to a line that connects between an output end (collector) of the power transistor 13 and the output terminal 12. The transistor C7 and the transistor C8 that are in diode connection have their control ends (bases) connected in common to constitute a current mirror circuit.

An output end (collector) of the transistor C7 is connected to a line that connects between the reference voltage circuit 16 and the negative-phase input end of the amplifier 17. An output end (collector) of the transistor C8 in diode connection is connected to an input end (emitter) of the transistor C4. The transistors C1 to C4, C7 and C8 constitute a bias switching circuit 33.

Further, a series circuit of resistors R10 and R11 and a series circuit of resistors R12 and R13 are provided between a line that connects between an output end (collector) of the power transistor 31 and the output terminal 30 and the ground. A connection end of the resistors R10 and R11 is connected to a positive-phase input end of the amplifier 32. An output end of the amplifier 32 is connected to a control end (base) of the power transistor 31. A connection end of the resistors R12 and R13 is connected to a control end (base) of the transistor C9 via a resistor R13.

Input ends (emitters) of transistors C10 and C11 that constitute a bias current circuit are connected to a line that connects between an output end (collector) of the power transistor 31 and the output terminal 30. The transistor C10 and the transistor C11 that are in diode connection have their control ends (bases) connected in common to constitute a current mirror circuit.

An output end (collector) of the transistor C10 is connected to a negative-phase input end of the amplifier 32, and is also connected to a line that connects between the reference voltage circuit 16 and the negative-phase input end of the amplifier 17. An output end (collector) of the transistor C11 in diode connection is connected to an input end (emitter) of the transistor C9. The transistors C9 to C11 constitute a bias switching circuit 34.

The operation of the series regulator according to the third embodiment will be explained next. When the external starting voltage source has started operation, the current mirror circuit of the transistors C5 and C6 operates to generate a constant current. Based on this, the current mirror circuit of the transistors C1 and C2 operates to supply a bias current from the transistor C1 to the reference voltage circuit 16. Based on this, a conversion voltage (constant voltage) of the bias current supplied is applied to the control end (base) of the transistor C3, and the transistor C3 is turned on.

When the constant bias current has been supplied to the reference voltage circuit 16, the reference voltage circuit 16 supplies a reference voltage to the negative-phase input ends of the amplifier 17 and the amplifier 32 respectively. Although not shown, a bias current is supplied at the same time from the input side to the amplifier 17 and the amplifier 32 respectively. Then, the amplifier 17 starts the operation of changing the internal resistance of the power transistor 13, and the amplifier 32 starts the operation of changing the internal resistance of the power transistor 31.

The output voltage of the power transistor 13 is divided by the series circuit of the resistors R5 and R6, and this divided voltage is supplied to the positive-phase input end of the amplifier 17. Further, the output voltage of the power transistor 13 is dived by the series circuit of the resistors R7 and R8, and this divided voltage V1 is applied to the control end (base) of the transistor C4.

Further, the output voltage of the power transistor 31 is divided by the series circuit of the resistors R10 and R11, and this divided voltage is supplied to the positive-phase input end of the amplifier 32. Further, the output voltage of the power transistor 31 is dived by the series circuit of the resistors R12 and R13, and this divided voltage V2 is applied to the control end (base) of the transistor C9.

In this case, resistances of the voltage-dividing circuit are set to have mutually different values for the divided voltages V1 and V2. When the output voltages of the power transistors 13 and 31 rise, the divided voltages V1 and V2 also rise respectively. Either the divided voltage V1 or V2 that has a higher voltage first rises to a value of a constant voltage that is being applied to the control end (base) of the transistor C3. Therefore, only the transistor C4 or C9 that is applied with the high divided voltage (for example, the transistor C4) is turned on, and the transistor C3 is turned off following this.

When the transistor C4 has been turned on, a current flows to the control ends (bases) of the transistors C7 and C8 respectively, and these transistors C7 and C8 are turned on. The transistor C7 starts supplying a bias current to the reference voltage circuit 16. At the same time, the transistor C3 is turned off. Therefore, the current mirror circuit of the transistors C1 and C2 is turned off.

As a result, the supply of the bias current from the transistor C1 to the reference voltage circuit 16 is interrupted. Thereafter, the output voltage Vout1 is constant even when there is a variation in the input voltage Vin. Therefore, the reference voltage circuit 16 receives a supply of the bias current having no variation from the output side. A separate output voltage Vout2 is obtained from the output terminal 30.

As explained above, when the series regulator has been structured to obtain two outputs, it is also possible to switch immediately the supply source of the bias current from the input side to the output side when the output voltage Vout has reached a predetermined voltage after the power source has been turned on, like in the first and the second embodiments. Therefore, it is also possible to reduce the influence on the reference voltage due to the variation in the input voltage.

In the case of obtaining two outputs, when the operation of the power transistor that generates an output voltage for supplying a bias current to the reference voltage circuit 16 has been stopped by an external protection circuit, for example, the supply of the bias current is interrupted. In this case, the ripple removal ratio is aggravated.

In order to solve this problem, there is provided a switching circuit for switching the on/off operations between the transistors C4 and C9, although not shown in the drawing. Assume, for example, the operation of the power transistor 13 has been stopped by an external protection circuit under a situation where the transistor C4 is operating based on a size relationship of V1>V2 between the divided voltages V1 and V2. Then, the size relationship between the divided voltages V1 and V2 changes to V1<V2. As a result, the switching circuit detects the change in the size relationship between the divided voltages V1 and V2, and immediately turns on the transistor C9.

As a bias current can be supplied immediately from the transistor C10 to the reference voltage circuit 16, it is possible to prevent the aggravation in the ripple removal ratio.

Figure 4:
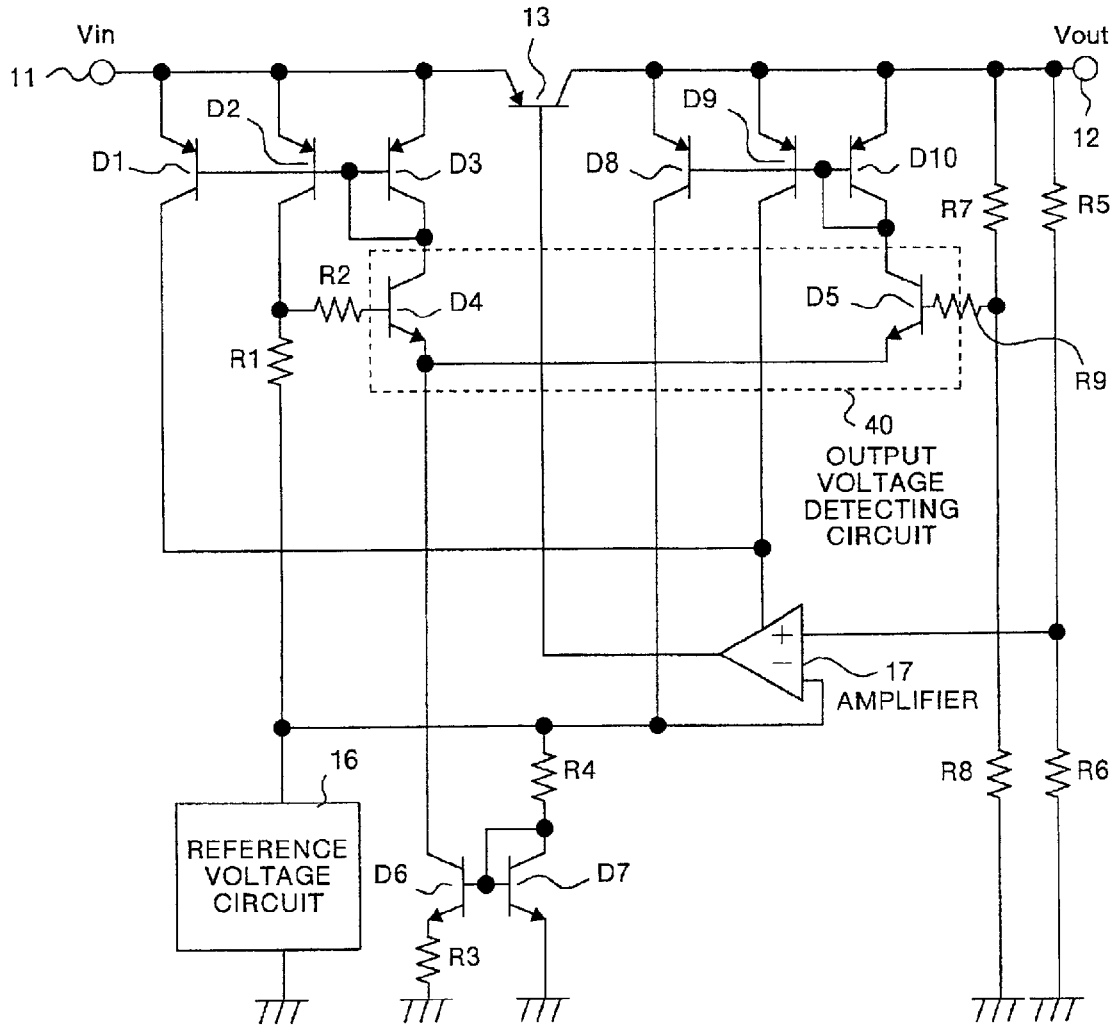
FIG. 4 is a circuit diagram showing a structure of a series regulator according to a fourth embodiment of the present invention.
Figure 5:
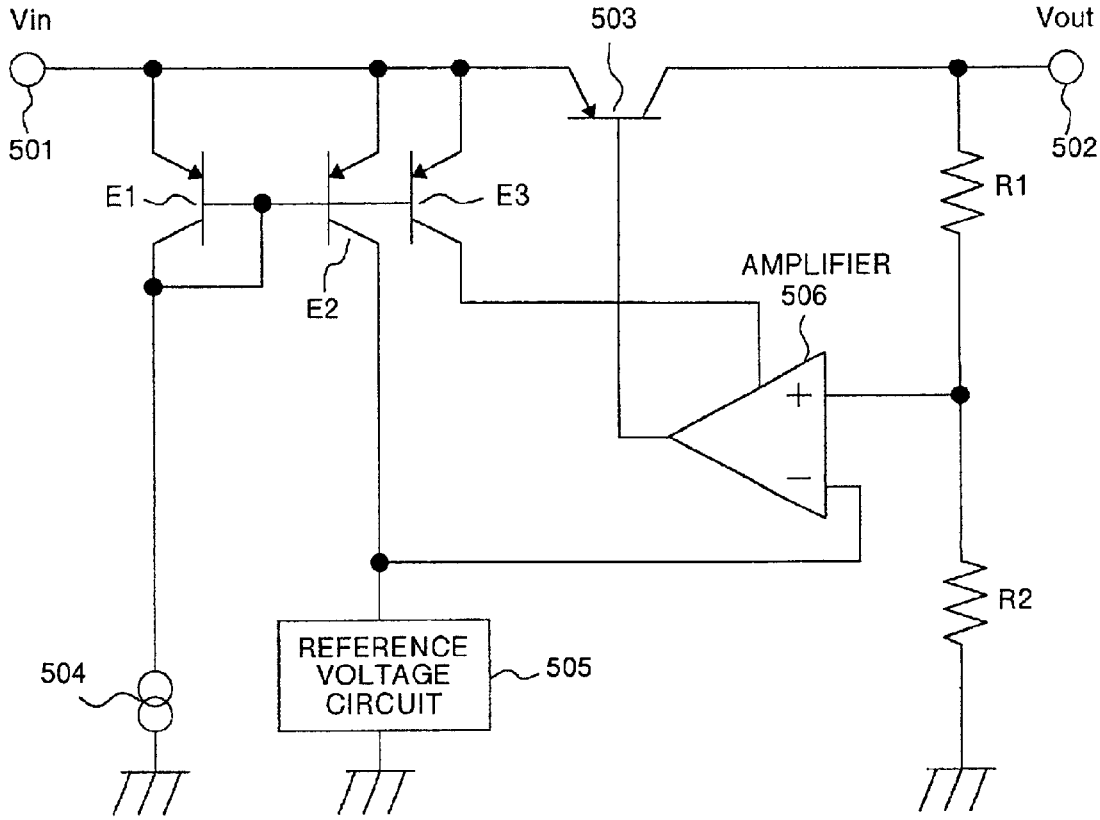
FIG. 5 is a circuit diagram showing a basic structure of a conventional series regulator.
Figure 6:
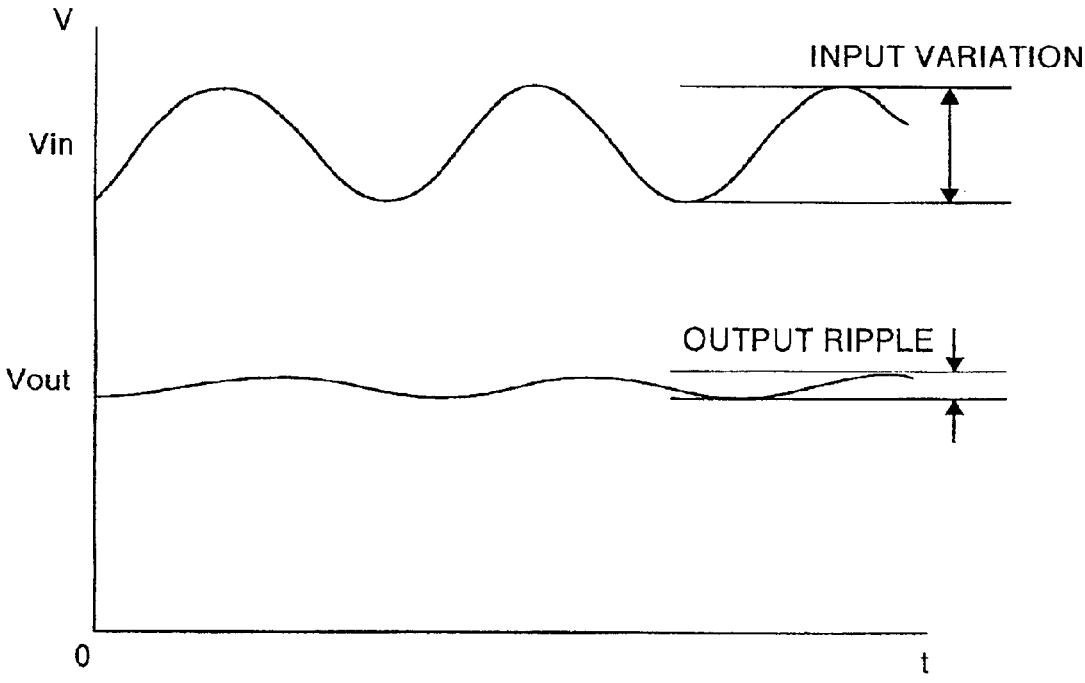
FIG. 6 is a diagram for explaining a relationship between an input voltage and an output voltage in a process of obtaining a constant output voltage after turning on a power source in the series regulator shown in FIG. 5.

FIG. 4 is a circuit diagram showing a structure of a series regulator according to a fourth embodiment of the present invention. The fourth embodiment shows an example of a structure of a series regulator that can also switch a supply of a bias current to the amplifier.

As shown in FIG. 4, a power transistor 13 is connected in series between an input terminal 11 to which a non-stabilized voltage Vin output from an external starting voltage source is applied and an output terminal 12 from which a stabilized voltage Vout is output. Input ends (emitters) of transistors D1, D2 and D3 that constitute a bias current circuit are connected to a line that connects between the input terminal 11 and an input end (emitter) of the power transistor 13.

The transistor D1, the transistor D2 and the transistor D3 that are in diode connection have their control ends (bases) connected in common to constitute a current mirror circuit. An output end (collector) of the transistor D1 is connected to a bias current input end of an amplifier 17. An output end (collector) of the transistor D2 is connected to a reference voltage circuit 16 via a resistor R1, and is also connected to a negative-phase input end of the amplifier 17. An output end (collector) of the transistor D3 in diode connection is connected to an input end (collector) of a transistor D4.

The transistor D4 has its control end (base) connected to an output end (collector) of the transistor D2 via a resistor R2. An output end (emitter) of the transistor D4 and an output end (emitter) of the transistor D5 are connected to an input end (collector) of a transistor D6. The transistor D6 has its control end (base) connected to a control end (base) of a transistor D7 in diode connection, and has its output end (emitter) connected to the ground via a resistor R3. The transistor D7 has its input end (collector) connected to a line that connects between the reference voltage circuit 16 and the negative-phase input end of the amplifier 17 via a resistor R4. An output end (emitter) of the transistor D7 is directly connected to the ground.

A series circuit of resistors R5 and R6 and a series circuit of resistors R7 and R8 are provided between a line that connects between an output end (collector) of the power transistor 13 and the output terminal 12 and the ground. A connection end of the resistors R5 and R6 is connected to a positive-phase input end of the amplifier 17. An output end of the amplifier 17 is connected to a control end (base) of the power transistor 13. A connection end of the resistors R7 and R8 is connected to a control end (base) of the transistor D5 via a resistor R9.

Input ends (emitters) of transistors D8, D9, and D10 that constitute a bias current circuit are connected to a line that connects between an output end (collector) of the power transistor 13 and the output terminal 12. The transistor D8, the transistor D9, and the transistor D10 that are in diode connection have their control ends (bases) connected in common to constitute a current mirror circuit.

An output end (collector) of the transistor D8 is connected to a line that connects between the reference voltage circuit 16 and the negative-phase input end of the amplifier 17. An output end (collector) of the transistor D9 is connected to a bias current input end of the amplifier 17. An output end (collector) of the transistor D10 in diode connection is connected to an input end (emitter) of the transistor D5. The transistors D4 and D5 constitute an output voltage detecting circuit 40.

The operation of the series regulator according to the fourth embodiment will be explained next. When the external starting voltage source has started operation, the current mirror circuit of the transistors D6 and D7 operates to generate a constant current. Based on this, the current mirror circuit of the transistors D1, D2 and D3 operates to supply a bias current from the transistor D1 to the amplifier 17, and supply a bias current from the transistor D2 to the reference voltage circuit 16. As a result, a conversion voltage (constant voltage) of the bias current supplied is applied to the control end (base) of the transistor D4, and the transistor D4 is turned on.

When the constant bias current has been supplied to the reference voltage circuit 16, the reference voltage circuit 16 supplies a reference voltage to the negative-phase input end of the amplifier 17. The amplifier 17 starts the operation of changing the internal resistance of the power transistor 13. The output voltage of the power transistor 13 is divided by the series circuit of the resistors R5 and R6, and this divided voltage is supplied to the positive-phase input end of the amplifier 17. Further, the output voltage of the power transistor 13 is dived by the series circuit of the resistors R7 and R8, and this divided voltage is applied to the control end (base) of the transistor D5.

When the output voltage of the power transistor 13 rises, and a value of the divided voltage applied to the control end (base) of the transistor D5 has risen to a value of a constant voltage applied to the control end (base) of the transistor D4, the transistor D5 is turned on and the transistor D4 is turned off in the output voltage detecting circuit 40.

When the transistor D5 has been turned on, a current flows to the control ends (bases) of the transistors D8, D9 and D10 respectively, and these transistors D8, D9 and D10 are turned on. The transistor D8 starts supplying a bias current to the reference voltage circuit 16. The transistor D9 starts supplying a bias current to the amplifier 17. At the same time, the transistor D4 is turned off. Therefore, the current mirror circuit of the transistors D1, D2 and D3 is turned off.

As a result, the supply of the bias current from the transistor D1 to the amplifier 17 is interrupted. Further, the supply of the bias current from the transistor D2 to the reference voltage circuit 16 is interrupted. Thereafter, the output voltage Vout is constant even when there is a variation in the input voltage Vin. Therefore, the reference voltage circuit 16 and the amplifier 17 receive a supply of the bias current having no variation from the output side respectively.

As explained above, according to the fourth embodiment, when the output voltage Vout has reached a predetermined voltage after the power source has been turned on, the supply source of the bias current is switched immediately from the input side to the output side. Therefore, it is possible to reduce the influence on the reference voltage due to the variation in the input voltage, more than that in the first to third embodiments. As a result, it is possible to reduce a ripple voltage that appears in the output voltage due to the variation in the input voltage, during a normal operation after a stable output voltage has been obtained following the turning-on of the power source. Consequently, it is possible to improve the ripple removal ratio of the series regulator.

In the fourth embodiment, FIG. 4 clearly shows a circuit that supplies a bias current from the input side to the amplifier, although this circuit is not shown in FIG. 1 to FIG. 3 that explain first to third embodiments. In the first to third embodiments, a bias current is also supplied from the input side to the amplifier in a similar circuit structure. In the fourth embodiment, there is also shown at the output side a transistor for supplying a bias current to the amplifier that is used in the second embodiment, and an example of the structure for the switching is also shown.

As is clear from the above explanation, in the first and third embodiments, it is also possible to provide at the output side a transistor for supplying a bias current to the amplifier, and employ a structure for switching the supply of a bias current to both the reference voltage circuit and the amplifier at the same time, in a similar method. As a result, it is possible to obtain more improved effects.

While the above embodiments show structures based on a bipolar transistor, the present invention is not limited to this, and it is also possible to construct a series regulator based on a unipolar transistor like FET and CMOS in a similar manner. It is needless to mention that these are also included within the scope of the present invention.

As explained above, according to one aspect of the present invention, when a non-stabilized voltage has been applied to an input terminal, a bias current is supplied to a reference voltage circuit from a first bias current circuit provided at the input side. Then, an amplifier starts the control of a power transistor. When the output voltage of the power transistor rises, and a value of a divided voltage generated by a resistance voltage dividing circuit has reached a value of a conversion voltage of the bias current, a second transistor is turned on in the output voltage detecting circuit. A second bias current circuit starts supplying a bias current to the reference voltage circuit. At the same time, a bias switching circuit operates to stop the bias-current supply operation of the first bias current circuit. Therefore, when the output voltage has reached a predetermined voltage after the power source has been turned on, it is possible to switch the supply source of the bias current immediately from the input side to the output side. As a result, it is possible to reduce a ripple voltage that appears in the output voltage due to the variation in the input voltage, during a normal operation after a stable output voltage has been obtained following the turning-on of the power source. Consequently, there is an effect that it is possible to improve the ripple removal ratio of the series regulator.

Furthermore, according to the another aspect of the present invention, a first bias current circuit provided at an input side and a second bias current circuit provided at an output side are differentially structured. Therefore, when a non-stabilized voltage has been applied to an input end, a first transistor is turned on, and a bias current is supplied from the first bias current circuit to a reference voltage circuit. Then, an amplifier starts controlling a power transistor. The first transistor is applied with a conversion voltage of the bias current, and continues the on-operation. A second transistor of the second bias current circuit that is differentially structured is in an off-status. When the output voltage of the power transistor rises, and a value of a divided voltage generated by a resistance voltage dividing circuit has reached a value of a conversion voltage of the bias current, the second transistor is turned on. Therefore, the second bias current circuit starts supplying a bias current to the reference voltage circuit. On the other hand, in the first bias current circuit, the first transistor is turned off. Therefore, the first bias current circuit stops supplying the bias current to the reference voltage circuit. It is possible to realize a bias switching circuit that has differentially structured the first bias current circuit provided at the input side and the second bias current circuit provided at the output side, by using a small number of elements. As a result, it is possible to reduce a ripple voltage that appears in the output voltage due to the variation in the input voltage, during a normal operation after a stable output voltage has been obtained following the turning-on of the power source. Consequently, there is an effect that it is possible, to improve the ripple removal ratio of the series regulator.

Moreover, according to still another aspect of the present invention, a first bias current circuit provided at an input side, a second bias current circuit provided at one output side, a third bias current circuit provided at the other output side are differentially structured. Therefore, when a non-stabilized voltage has been applied to an input end, a first transistor is turned on, and a bias current is supplied from the first bias current circuit to a reference voltage circuit. Then, a first amplifier starts controlling a first power transistor, and a second amplifier starts controlling a second power transistor. The first transistor is applied with a conversion voltage of the bias current, and continues the on-operation. A second transistor of the second bias current circuit and a third transistor of the third bias current circuit that are differentially structured are in an off-status. When the output voltages of the first and second power transistors rise, and when either a first divided voltage generated by a first resistance dividing circuit or a second divided voltage generated by a second resistance dividing circuit having a higher value has first reached a value of the conversion voltage, the corresponding one of the second transistor and the third transistor is turned on. The first transistor is turned off following this. A bias current is supplied to the reference voltage circuit from the corresponding one of the second bias current circuit and the third bias current circuit. At the same time, the first bias current circuit stops supplying the bias current. Stabilized voltages are output from the two output terminals respectively. Therefore, it the case of obtaining two outputs, it is also possible to switch the bias current supply source from the input side to the output side. As a result, it is possible to reduce a ripple voltage that appears in the output voltage due to the variation in the input voltage, during a normal operation after a stable output voltage has been obtained following the turning-on of the power source. Consequently, there is an effect that it is possible to improve the ripple removal ratio of the series regulator.

Furthermore, when a bias current is being supplied based on an output voltage of one of the first power transistor and the second power transistor, the on/off operations of the second transistor and the third transistor are switched to each other at the time of stopping the operation of the power transistor that is generating this output voltage. With this arrangement, it is possible to switch a supply source of a bias current to the other source having a different bias current. Consequently, there is an effect that it is possible to improve the ripple removal ratio of the series regulator.

Furthermore, the switching of a bias-current supply to the amplifier is also executed in addition to the switching of a bias-current supply to the reference voltage circuit. Consequently, there is an effect that it is possible to further improve the ripple removal ratio of the series regulator.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A series regulator comprising:

a power transistor connected in series between an input terminal to which a non-stabilized voltage is applied and an output terminal;

an amplifier for changing an internal resistance of the power transistor based on a comparison between an output voltage of the power transistor and a reference voltage, and outputting a stabilized constant voltage to the output terminal;

a first bias current circuit for generating a bias current to be supplied to a reference voltage circuit that generates the reference voltage, based on the non-stabilized voltage applied to the input terminal;

a voltage dividing circuit for generating a divided voltage from the output voltage of the power transistor;

an output voltage detecting circuit including a first transistor having a control terminal to which is applied a conversion voltage corresponding to the bias current that the first bias current circuit supplies to the reference voltage circuit; and a second transistor having a control terminal to which is applied the divided voltage, wherein the second transistor is turned on and the first transistor is turned off when the divided voltage has reached the conversion voltage;

a second bias current circuit for generating a bias current to be supplied to the reference voltage circuit in response to on-operation of the second transistor, based on the output voltage of the power transistor; and a bias switching circuit for stopping bias-current supply by the first bias current circuit in response to starting of operation of the second bias current circuit.

2. The series regulator according to claim 1, wherein the first bias current circuit and the second bias current circuit supply a bias current to the amplifier, and switching of a bias-current supply to the amplifier is linked to switching of a bias-current supply to the reference voltage circuit.

3. A series regulator comprising:

a power transistor connected in series between an input terminal to which a non-stabilized voltage is applied and an output terminal;

an amplifier for changing an internal resistance of the power transistor based on a comparison between an output voltage of the power transistor and a reference voltage, and outputting a stabilized constant voltage to the output terminal;

a voltage dividing circuit for generating a divided voltage from the output voltage of the power transistor;

a first bias current circuit for generating a bias current to be supplied to a reference voltage circuit that generates the reference voltage, based on the non-stabilized voltage applied to the input terminal, the first bias current circuit supplying a bias current to the reference voltage circuit during a period while a first transistor, having a control terminal to which a conversion voltage corresponding to the bias current is applied, is in an on-operation; and a second bias current circuit for generating a bias current to be supplied to the reference voltage circuit, based on the output voltage of the power transistor, the second bias current circuit for supplying a bias current to the reference voltage circuit during a period while a second transistor, having a control terminal to which the divided voltage is applied, is in an on-operation, wherein the second transistor is turned on when the divided voltage has reached the conversion voltage, and the first transistor is subsequently turned off.

4. The series regulator according to claim 3, wherein the first bias current circuit and the second bias current circuit supply a bias current to the amplifier, and switching of a bias-current supply to the amplifier is linked to switching of a bias-current supply to the reference voltage circuit.

5. A series regulator comprising:

a first power transistor connected in series between an input terminal to which a non-stabilized voltage is applied and a first output terminal;

a first amplifier for changing an internal resistance of the first power transistor based on a comparison between an output voltage of the first power transistor and a reference voltage, and outputting a stabilized constant voltage to the first output terminal;

a second power transistor connected in series between the input terminal and a second output terminal;

a second amplifier for changing an internal resistance of the second power transistor based on a comparison between an output voltage of the second power transistor and the reference voltage, and outputting a stabilized constant voltage to the second output terminal;

a first voltage dividing circuit for generating a first divided voltage from the output voltage of the first power transistor, and a second voltage dividing circuit for generating a second divided voltage, different from the first divided voltage, from the output voltage of the second power transistor;

a first bias current circuit for generating a bias current to be supplied to a reference voltage circuit that generates the reference voltage, based on the non-stabilized voltage applied to the input terminal, the first bias current circuit supplying a bias current to the reference voltage circuit during a period while a first transistor, having a control terminal to which a conversion voltage corresponding to the bias current is applied, is in an on-operation;

a second bias current circuit for generating a bias current to be supplied to the reference voltage circuit, based on the output voltage of the first power transistor, the second bias current circuit supplying a bias current to the reference voltage circuit during a period while a second transistor, having a control terminal to which the first divided voltage is applied, is in an on-operation; and a third bias current circuit for generating a bias current to be supplied to the reference voltage circuit, based on the output voltage of the second power transistor, the third bias current circuit supplying a bias current to the reference voltage circuit during a period while a third transistor, having a control terminal to which the second divided voltage is applied, is in an on-operation, wherein only a corresponding one of the second transistor and the third transistor is turned on when the one of the first divided voltage and the second divided voltage having a higher value has first reached the conversion voltage, and the first transistor is subsequently turned off.

6. The series regulator according to claim 5, further comprising a circuit for switching on/off operations between the second transistor and the third transistor to stop operation of the one of the first power transistor and the second power transistor that is generating an output voltage on which basis the bias current is being supplied.

7. The series regulator according to claim 5, wherein the first bias current circuit, the second bias current circuit, and the third bias current circuit supply a bias current to the amplifiers, and switching of a bias-current supply to the amplifier is linked with switching of a bias-current supply to the reference voltage circuit.

* * * * *